United States Patent [19]

Silverman

[11] Patent Number: 4,807,883

[45] Date of Patent: Feb. 28, 1989

[54] GAME APPARATUS AND DICE CONSTRUCTION THEREFOR

[76] Inventor: Hyman P. Silverman, 620 South Alton Way, Apt. 5C, Denver, Colo. 80231

[21] Appl. No.: 144,966

[22] Filed: Jan. 19, 1988

[51] Int. Cl.[4] ..... A63F 9/04

[52] U.S. Cl. ..... 273/145 C; 273/146

[58] Field of Search ..... 273/146, 145, 144; D21/41

[56] References Cited

U.S. PATENT DOCUMENTS

| | | | |
|---|---|---|---|
| 434,613 | 8/1890 | Turner . | |
| 1,054,341 | 2/1913 | Cowles . | |
| 1,223,365 | 4/1917 | Breitung | 273/146 |
| 1,539,015 | 5/1925 | Mitchell | 273/146 |
| 1,602,841 | 10/1926 | Bonnell | 273/146 X |
| 3,106,402 | 10/1963 | Rushing, Jr. | 273/144 |
| 3,109,652 | 11/1963 | Strano et al. | 273/134 |
| 3,649,017 | 3/1972 | Kirkpatrick | 273/146 X |
| 3,779,554 | 12/1973 | Brix | 273/131 |
| 3,905,603 | 9/1975 | Hoetzel | 273/138 |
| 4,095,796 | 6/1978 | Monsoa | 273/145 |
| 4,108,431 | 8/1978 | Camara | 273/1 R |
| 4,146,229 | 3/1979 | Morse | 273/150 |
| 4,239,226 | 12/1980 | Palmer | 273/146 |
| 4,261,572 | 4/1981 | Breinholt | 273/161 |
| 4,421,315 | 12/1983 | Cutler | 273/146 X |
| 4,632,397 | 12/1986 | Rivkin | 273/145 |

FOREIGN PATENT DOCUMENTS

| | | | |
|---|---|---|---|
| 3240494 | 5/1984 | Fed. Rep. of Germany | 273/144 B |
| 3337670 | 4/1985 | Fed. Rep. of Germany | 273/146 |
| 2447212 | 9/1980 | France | 273/146 |
| 2474878 | 8/1981 | France | 273/146 |
| 2594705 | 8/1987 | France | 273/146 |

*Primary Examiner*—Paul E. Shapiro
*Attorney, Agent, or Firm*—John E. Reilly

[57] ABSTRACT

A game apparatus can be releasably or permanently secured to a gaming table in such a way as to pivotally support a hollow, transparent container or other gambling unit for swinging movement across the table. The container is journaled at the end of a pivotal support arm so that each player in turn can rotate or tumble the dice in the container and permit the container to coast to a stop with the dice resting on the lower interior of the container. Odd-sided dice are preferably employed in combination with a mirrored surface beneath the lower interior end of the container so that the numbers on the dice, when the container comes to rest, are reflected by the mirrored surface for ease of reading by the players. In a modified form, a braking mechanism is employed to retard tumbling or rotation of the container or other gambling unit so as to reduce the time required for the container or unit to come to a complete stop.

20 Claims, 3 Drawing Sheets

GAME APPARATUS AND DICE CONSTRUCTION THEREFOR

This invention relates to games of chance; and more particularly relates to novel and improved game apparatus of the type employing indicia-bearing game pieces which must be shaken or tumbled in a random manner to produce different combinations of indicia.

BACKGROUND AND FIELD OF THE INVENTION

Numerous games of chance require the use of indicia-bearing units, such as, dice which must be shaken or thrown across a table surface or tumbled in a container. When the units come to rest, the indicia on the upper surfaces of the units are compared with different indicia combinations on the table surface. For example, in the game of "craps" as played in a gambling casino, the dice are rolled by each player across a generally tank-type table surface, and when the dice come to rest the numbers on the upper surfaces are compared with different number combinations on the table. The game as presently played requires one or more boxmen, two dealers to handle the bets and a stickman to control the playing of the game itself and to recover the dice for each next turn in succession. Customarily, in the game of craps, each standard die has six different sides or surfaces bearing a different number from one to six. Accordingly, the total combination of numbers are limited to the number combinations from a pair of dice. Moreover, there are definite limitations from the standpoint of enabling all players to read the dice as well as to avoid misplaying or cheating.

Certain games of chance utilize transparent containers in which the dice are placed so that the dice can be shaken by tumbling or rotating the container and, when the container comes to rest, the indicia are read off the surfaces of the dice which are visible to the players. In addition, dice boxes have been mounted on horizontally vibrating spring arms for the purpose of agitating the dice and when the box comes to rest the dice can be read through a transparent top of the box.

SUMMARY OF THE INVENTION

Accordingly an object of the present invention is to provide for a novel and improved game device which is conformable for professional or recreational use, is portable and readily usable in different games requiring the use of dice or similar game pieces.

Another object of the present invention is to provide for a novel and improved game apparatus which is extremely versatile and which facilitates use of a tumbling container in cooperation with a mirror for viewing of selected indicia on the game pieces.

It is another object of the present invention to provide for a novel and improved game apparatus of the type in which multi-sided game pieces of novel and improved construction greatly expand the number of selections of indicia on each piece.

It is a further object of the present invention to provide for a novel and improved game apparatus in which a rotating or tumbling container can undergo controlled advancement across the entire table surface and can be manually rotated by each player for increased participation in the game.

A still further object of the present invention is to provide for a novel and improved gaming apparatus adaptable for use in playing the game of craps and similar games in which the game pieces or dice are enclosed in a container and can be tumbled or shaken by each participating player with controlled retardation or braking of the container so that the container will coast to a stop in a minimum of time and in a position to enable consistent reading of the dice at the lower interior of the container.

In accordance with the present invention, a game device comprises the combination of a hollow transparent container having opposite end portions, first support means to support the container for swinging movement about a vertical axis spaced horizontally from the container, second support means to rotatably support the container with respect to the first support means for rotation about a horizontal axis extending through the first support means until the container comes to rest in a generally vertical attitude, and at least one multi-sided game piece loosely disposed in the container such that rotation of the container is operative to cause tumbling of the game piece in the container until the container comes to rest with the game piece resting on a lower interior surface of one end of the container. In the preferred and modified forms of invention, the first support means takes the form of a pivot member and pivot holder to support the pivot member for movement about a vertical axis, and the second support means includes a horizontal arm extending from the pivot member including a bearing member to support the container for rotation at one end of the arm. In a modified form of invention, braking means are provided to retard the spinning or rotation of the container or other gambling unit mounted at the end of the arm so as to cause it to come to rest in a minimum of time.

A preferred form of game piece for utilization with the container game device of the present invention is a die of generally polygonal configuration having an odd number of sides or flat surfaces with a different number of dots arranged in consecutive numerical order on the sides starting with the number "1", and a numeral corresponding to the number of dots on each side which is located on a portion of the piece diametrically opposite to that side so that when the piece is tossed or tumbled and comes to rest on one of the sides, the numeral representing that side will appear on the uppermost portion of the piece. A mirror aligned with one of the opposite end portions on the container can be utilized to reflect the image of the indicia on the bottom of each game piece when the game piece and container come to rest.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
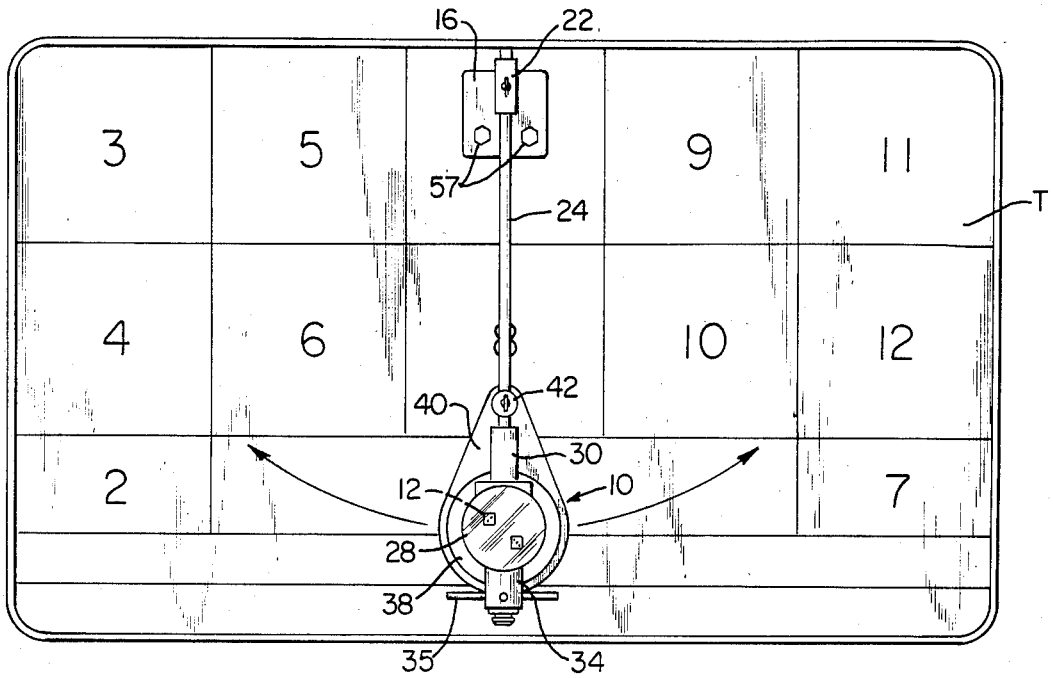
FIG. 1 is a top plan view of a preferred form of game apparatus in accordance with the present invention.
Figure 2:
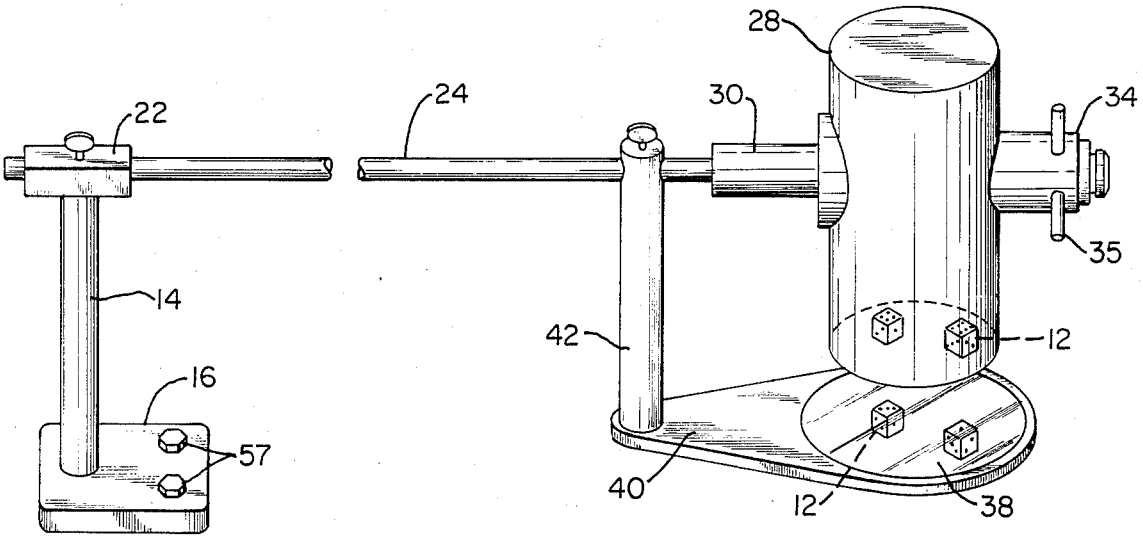
FIG. 2 is a generally perspective view of the preferred form of apparatus.
Figure 3:
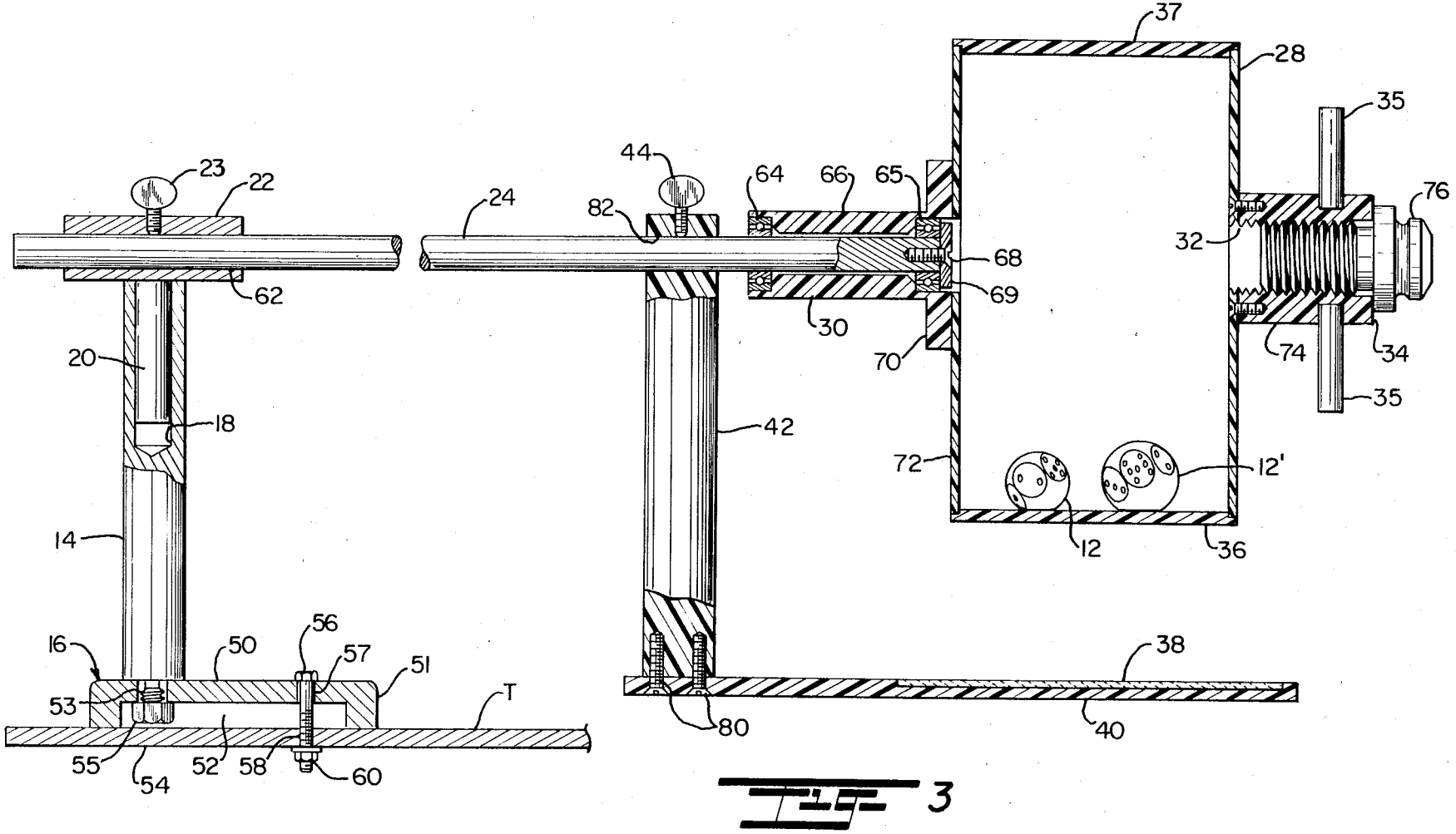
FIG. 3 is a front view in elevation and partially in section of the preferred form of game apparatus.

Referring in more detail to the drawings, there is illustrated in FIGS. 1 to 3 a preferred form of game apparatus 10. As a setting for the present invention, FIG. 1 illustrates the game apparatus 10 mounted on a game board or table designated at T and which bears various indicia or numbers on the upper surface of the table or board to be matched with corresponding indicia or number combinations thereof on game pieces 12 which form a part of the game apparatus of the present invention to be hereinafter described in more detail. For example, the indicia on the game board is representative of various number combinations used in the playing of dice games, such as, craps.

In the preferred form of game apparatus 10, a pivot holder 14 is in the form of an upstanding post 14 on a base or clamping fixture 16 to be affixed to the table T. As shown in FIGS. 2 and 3, the upper end of post 14 is provided with a counterbore 18 for insertion of a pivot pin 20 depending downwardly from a sleeve 22. Sleeve 22 is provided with a locking screw 23 for adjustable locking of the arm support member 24 which is inserted into sleeve 22 for horizontal extension at right angles to the pivot pin 20 away from the post 14. Arm support member 24 is preferably of elongated solid cylindrical configuration and of a length to traverse the substantial width of the game board or table surface as shown in FIG. 1.

A transparent hollow cylindrical container 28 is journaled on the free end of the arm 24 by bearing sleeve 30. An access port 32 is formed in a wall of the container opposite to the bearing sleeve 30 with a removable closure 34 over the access port for selective insertion and removal of the game pieces 12 in the container 28. The container 28 has opposite end portions 36 and 37 which are in the form of flat, circular transparent disks so as to form a fully enclosed container, and a reflective surface or mirror 38 is positioned on a stand 40 spaced beneath the lower transparent end 36 of the container. The stand 40 is fixed with respect to the container by means of a vertical arm 42 which depends downwardly from the horizontal support arm 24 and is releasably locked in place by locking screw 44. In this relation, the container 28 is rotatable by manual rotation of the lugs 35 on the closure 34 so as to cause the game pieces 12 to toss within the container 28 until the container 28 comes to rest with the game pieces landing on the bottom surface 36. Again, the container is rotated with respect to the support arm and to the stationary reflective surface 38 so that the indicia on the game pieces 12, to be hereinafter described, can be viewed or read off of the reflective surface 38 and compared with indicia on the game board.

An important feature of the present invention resides in the ability of the rotatable container 28 to be pivoted about the vertical axis through the pivot pin 20 so that it can be swung or advanced horizontally across the table surface. In this way, a plurality of players can be stationed around the game board or table surface and the container advanced across the table surface so that each player in turn can toss the dice by rotating the container as described.

Considering in more detail the construction and arrangement of parts comprising the preferred form of game apparatus 10, the base or platform 16 is preferably of generally rectangular configuration having a raised horizontal portion 50 and downwardly extending, outer surrounding walls 51 so as to form a space 52 between the horizontal portion 50 and table surface T. Within the space 52, a threaded extension 53 extends downwardly from the lower end of the post 14 through a bore 54 in the horizontal portion to receive a lock nut 55 in order to firmly attach the post in upstanding relation to the surface 50. A pair of carriage bolts 56 extend downwardly through aligned bores 57 in the horizontal portion 50 and 58 in the table T to secure the base 16 to the table surface by means of a nut 60.

The pivot pin 20 is permanently attached to the square tube 22, the tube 22 having a generally cylindrical bore 62 through which the circular shaft defining the arm support member 24 extends. At the opposite end of the arm or shaft 24, bearing 30 has ball bearing races 64 and 65 at opposite ends of a circular sleeve 66, and the bearing 30 is supported in place on the free end of the shaft 24 by a screw 68 threaded into the end of the shaft 24 and having an enlarged head 69 bearing against the bearing races 65. The sleeve 66 terminates in an enlarged arcuate flange 70 permanently attached by welding or bonding to the external cylindrical surface of the container 28. Preferably, the container 28 is affixed to the sleeve such that the horizontal axis of the arm 24 extends through the container at a point just above the midpoint of the container 28 so that the container will consistently come to rest in a generally vertical position as shown.

The container 28 is preferably formed of a generally cylindrical wall 72 having the opposite end portions 36 and 37, the wall 72 and end portions 36, 37 preferably composed of a clear plastic or Plexiglas material so that the game pieces 12 or D are clearly visible through the container. The closure 34 is aligned with the port 32 in the wall 72 diametrically opposite to the bearing 30 and includes an internally threaded tube 74 with a plug 76 threaded into the external end of the tube 74. The spokes 35 emanate or extend radially in circumferentially spaced relation about the tube 74 to facilitate manual grasping and rotation of the container by each player.

The mirror 38 is permanently attached such as by bonding to the upper surface of the stand 40, the stand 40 being secured to the post 42 by suitable screws 80 extending upwardly through the stand 40 into the lower end of the post 42. The post 42 is preferably solid except for a transverse bore 82 at its upper end which receives the arm support member 24, and the locking screw 44 secures the post 42 and stand 40 in fixed relation to the arm support member.

DETAILED DESCRIPTION OF MODIFIED FORM OF INVENTION

Figure 4:
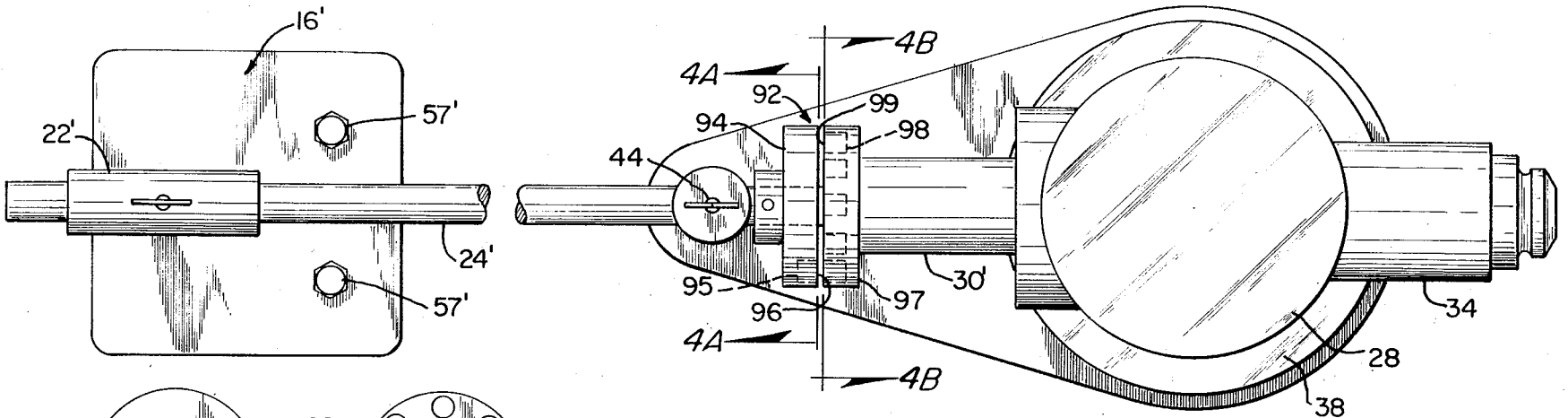
FIG. 4 is a top plan view in detail of a modified form of game apparatus.
Figure 4B:
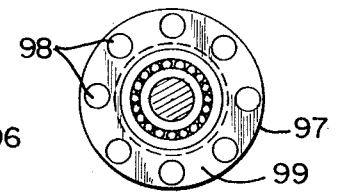
FIGS. 4A and 4B are cross-sectional views taken about lines 4A and 4B, respectively, of FIG. 4.
Figure 4A:
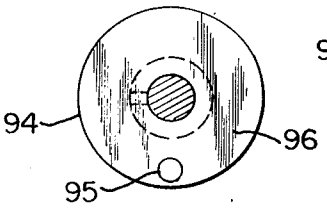
Figure 6:
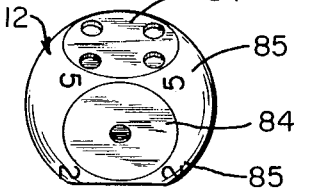
FIG. 6 is a view taken at right angles to that of FIG. 5 of a five-sided game piece.
Figure 5:
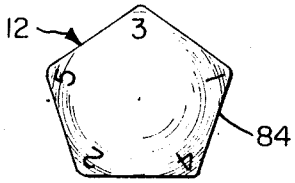
FIG. 5 is a front view of a five-sided game piece.

A modified form of invention is illustrated in FIGS. 4, 4A and 4B wherein like parts to those of the preferred embodiment are correspondingly enumerated with prime numerals. The novel feature of the modified form is a braking mechanism generally designated at 92 including a stationary disk 94 which is affixed to the support arm 24' directly adjacent to sleeve 30', the sleeve 30' being journaled on the free end of the arm 24'. The stationary disk 94 is provided with a permanent magnet 95 inserted in an opening on the outer periphery of face 96 of the disk 94 and in facing relation to the sleeve 30'. The magnetic member 95 is preferably in the form of a disk with a flat surface disposed flush with the face 96 of the disk 94 so that the magnetic field of the disk is aligned parallel to the axis of the disk 94. A second generally annular disk 97 is affixed to the bearing sleeve 30' and provided with a plurality of metallic, disk-shaped elements 98 at equally spaced circumferential intervals around the outer periphery of surface 99. The members 98 are similarly formed with flat surface portions disposed flush with the face 99 and are so disposed on the outer periphery of the disk 97 as to pass across the flat confronting surface of the magnetic member 95 in the stationary disk 96 when the container is tumbled or rotated. The magnetic field of the disk 95 is such that it will serve to attract the metallic disks 98 when the container is tumbled and operate somewhat to retard the rotation of the container 28 by virtue of the magnetic attraction between the magnet 95 and metallic elements 98. Although not shown, the container 28 is mounted in offset relation to the support arm 24 so that the same end 36 will come to rest at the bottom of the container to facilitate reading of the dice off of the mirrored surface 38.

It will be evident that the brake mechanism as described in combination with the pivotal support arm may be employed with other specific forms of rotatable gambling units, such as, roulette wheels and accomplish the same objective in retarding the speed of rotation of the device so that it will come to a stop in a considerably reduced time period as compared to merely permitting the device to freely spin. Moreover, it should be noted that it is not essential to mount the container 28 in offset relation to the support arm 24 as long as opposite ends of the container are transparent and will permit reading or projection of the images of the numbers on the dice from either end of the container 28 off of the mirrored surface.

DETAILED DESCRIPTION OF PREFERRED FORM OF DICE

The dice D illustrated in FIGS. 1 and 2 are of conventional construction and illustrate the utilization of conventional game pieces within a container in which the number of dots on the bottom surfaces of the dice can be viewed by virtue of their reflected image through the mirror 38. However, FIGS. 5 to 8 illustrate utilization of preferred forms of game piece 12 for playing more sophisticated dice games. In the form of game piece 12 illustrated in FIGS. 5 and 6, the game piece is composed of a solid block of generally spherical construction with an odd number of sides 84, each side being a flat surface and arranged in a circle around the block and evenly spaced with intervening surfaces 85 which form a continuation of the spherical external surface of the block. Each side or flat surface 84 bears a different number of dots in consecutive numerical order starting with the number "1". However, there is no particular sequence or relationship required between numbers on adjacent surfaces and, as shown for example, in FIG. 6 the adjacent surfaces illustrated bear the numbers of "1" and "4". It should be further noted that a numeral corresponding to the number of dots on each flat surface is located on an intervening surface portion on the block opposite to that flat surface. In this way, when the block is tossed or shaken in the container and comes to rest on one of the flat surfaces 84, the numeral corresponding to that flat surface is at the uppermost portion of the block and can be readily viewed directly through the wall of the container. In addition, the number of dots on the bottom surface resting on the end surface of the container can be viewed through the reflected image on the mirror 38.

Figure 7:
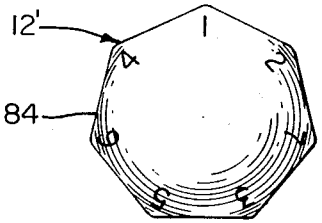
FIG. 7 is a front view of a seven-sided game piece.
Figure 8:
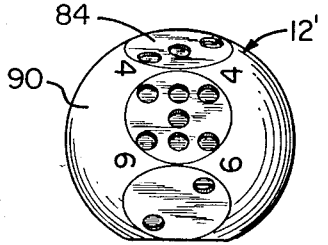
FIG. 8 is a view taken at right angles to that of FIG. 7 of the seven-sided game piece.

FIGS. 7 and 8 illustrate a modified form of block 12' having seven sides 84 which are formed out of the block and specifically in the form of chordally extending flat surfaces each bearing a different number of dots in ascending numerical order from the number "1". Again, when the dice are tossed or rolled, they will come to rest on one of the flat surfaces and the number of dots viewed through the mirror 38. A numeral corresponding to the number of dots on the bottom surface again will appear as at 90 on the uppermost spherical portion of the block. Preferably, an odd number of sides is formed in each block and are arranged to extend around the block in a common or single row or circle. Nevertheless, if additional sides are desired, they should be symmetrically arranged with respect to one another so that there is no tendency for the game piece to come to rest on any single surface and will be purely at random.

The ease of assembly of the game apparatus can be readily appreciated from a consideration of FIG. 3. For instance, the game pieces 12 and 12' are placed in the container through the access port 32 simply by removal of the plug 76. The arm support member 24 is inserted through the upper end of the post 32 with the mirror 38 aligned directly beneath the container 28, and the post is affixed to the arm support by the locking screw 44. In turn, the end of the arm support member opposite to the container 28 is inserted through the tube 22 at the upper end of the pivot pin 20 and locked in place by the locking screw 23. The entire assembly may be clamped to the table surface, as described, or the pivot support member 14 and base may be clamped to the table surface prior to assembly of the arm support 24. Preferably, the assembly is clamped to the table T at an intermediate portion, and the arm support 24 is positioned such that the container can traverse the substantial width and length of the table T in advancing between a number of players stationed around the table. Each player in turn has an opportunity to effectively "roll" the dice by manually rotating the container as described and permitting the container to come to rest with the lower end wall 36 aligned in spaced relation above the mirror 38. The number on the game pieces is then read off of the mirrored surface or the numerals which appear at the uppermost portion of the pieces and compared with the number combinations on the board. Utilization of the oddsided game pieces permits a greater number of variations in combinations of numbers than with conventional dice. Moreover, the reflective surface or mirror 38 is merely representative of various means that can be employed to reflect or project the image of the indicia on the bottom surfaces of the game pieces so that the number can be clearly viewed by all of the players and dealer; and, for example, the image may be magnified or projected onto a screen if desired.

There is illustrated in FIG. 1 the mounting of the preferred form of invention on the table T which contains an illustrative layout for playing a game of "Roulette Craps". "Roulette Craps" is a dice game similar to roulette. Like roulette, every throw of the dice results in a decision. For example, if it is played on a table with a layout as shown in FIG. 1, the game would require a dealer on one layout; if a double layout were used (as in standard craps) the game would require two dealers, a stickman and a boxman.

At the start of the game, the dice are passed to the player on the dealer's (or stickman's) immediate left, who becomes the shooter and holds the dice until a "2" or "12" is thrown. The container 28 with dice 12 is swung in a clockwise manner to the next player. A player can refuse the dice or pass them on at any time. When the shooter throws the dice by tumbling the container 28, a marker (as in roulette) can be placed on the number thrown in the layout, and all bets are collected or paid off.

The layout shows all the craps numbers in squares. For instance, numbers "3", "5", "8", "9" and "11" may be colored black; and numbers "4", "6", "7" and "10" may be colored red. These two groups of numbers each represent seventeen possible combinations in the toss of the dice, and are even bets. Although not shown, the bottom of the layout may include groups of numbers, namely, "3", "5", "7", "10" and "11"; and "4", "6", "8" and "9" for betting different possible number combinations. Typically, other odds can be listed on all bets in the layout: single numbers, three numbers (1), and four numbers. As noted above, the even bets may be listed at the bottom of the layout.

It is therefore to be understood from the foregoing that various modifications and changes may be made in the composition of materials, construction and arrangement of parts comprising the preferred and modified forms of invention as set forth and described herein without departing from the spirit and scope of invention as defined by the appended claims and reasonable equivalents thereof.

I claim:

1. In a game device, the combination comprising:

a hollow, transparent container having opposed end portions;

first support means supporting said container for swinging movement about a vertical axis spaced horizontally from said container;

second support means for rotatably supporting said container with respect to said first support means for rotation of said container about a horizontal axis extending through said first support means until said container comes to rest in a generally vertical attitude; and at least one multi-sided game piece loosely disposed in said container whereby rotation of said container is operative to cause tumbling of said game piece(s) in said container until said container comes to rest with said game piece(s) resting on a lower interior surface of one end of said container.

2. In a game device according to claim 1, said first support means having a pivot member and pivot holder means supporting said pivot member for pivotal movement about a vertical axis.

3. In a game device according to claim 2, said pivot holder means including a base support member and an upstanding post provided with a counterbore at its upper end, and said pivot member being defined by a pivot pin journaled in said counterbore at the upper end of said post.

4. In a game device according to claim 1, said second support means having a horizontal arm portion extending from said first support means and a bearing member connecting said container in journaled relation to said arm member.

5. In a game device according to claim 4, said container including a generally tubular wall between said opposite end portions, and said bearing member extending from said wall normal to the longitudinal axis of said container and at a location nearer to one of said opposed end portions than to the other end of said opposed end portions.

6. In a game device according to claim 1, said second support means including means adjustably connecting said second support means to said first support means to vary the spacing between said container and said first support means.

7. In a game apparatus wherein there is provided a flat horizontal game board, the combination comprising:

a pivotal support member located adjacent to one side edge of said game board;

arm support means connected to said pivotal support member for movement in a generally horizontal plane in spaced relation to and above said game board;

a transparent, hollow, generally cylindrical container having spaced parallel end walls and including means connecting said container in journaled relation to said arm support member above said game board whereby said container is manually rotatable about said arm support member until said container comes to rest in a generally vertical attitude;

a plurality of game pieces disposed in said container having an odd number of sides, each side bearing different indicia thereon; and reflecting means aligned with one of said end walls of said container to reflect the image of said indicia on the bottom of each game piece through said one of said end walls when said container comes to rest.

8. In a game apparatus according to claim 7, said reflecting means defined by a mirror, and means mounting said mirror in fixed relation to said arm support means and in axially spaced relation to said container.

9. In a game apparatus according to claim 8, said mounting means mounting said mirror in axially spaced relation to and beneath said one of said end walls when said container comes to rest.

10. In a game apparatus according to claim 7, said arm support means connected to said container in offset relation to the length of said container, and a game piece access port in said tubular wall of said container diametrically opposite to said arm support means.

11. In a game apparatus according to claim 10, said game board displaying various indicia thereon corresponding to the indicia on said game pieces.

12. In a game apparatus according to claim 7, the indicia on said game pieces comprising a series of dots arranged in consecutive numeral order on each side starting with the number "1" and a numeral on a portion of each game piece diametrically opposite to each side which represents the number of dots on each respective side.

13. A game piece comprising a block of generally spherical configuration having a plurality of sides in the form of flat surfaces of corresponding size and configuration with respect to one another and provided with intervening surfaces between adjacent of said sides one intervening surface being located diametrically opposite each flat surface, each flat surface being an external surface and having a different number of dots, the number of dots on different faces increasing in consecutive numerical order starting with one dot, and a plurality of numerals, each numeral corresponding to the number of dots on a different one of each said flat surface, each said numeral being located on the intervening surface diametrically opposite to the flat surface having the number of dots corresponding to that numeral so that when the piece is thrown or tossed and comes to rest on one of said flat surfaces with that surface lowermost, the numeral corresponding to the number of dots on that flat surface will appear on the uppermost portion of said piece.

14. A game piece comprising a block having an odd number of interconnected sides, each side being a flat surface and said sides arranged symmetrically on said block with intervening surfaces between adjacent sides, each said flat surface bearing a different number of dots in consecutive numerical order starting with the number 1, and a numeral corresponding to the number of dots on each flat surface being located on an intervening surface portion on said block opposite to each associated flat surface such that when the block is tossed and comes to rest on one of said flat surfaces, the numeral corresponding to that flat surface is in upwardly facing relation on the uppermost portion of said block.

15. A game piece according to claim 14, said intervening surfaces between said flat surfaces being rounded.

16. A game piece according to claim 14, said block being of generally spherical configuration and said flat surfaces defining chordally extending portions formed out of said sphere.

17. A game piece according to claim 14, said block having an odd number of sides extending in a circumferential row around said block.

18. In a gambling device wherein a gambling unit is of the type having a series of indicia which is operative to be rotated and to coast into a position of rest to present one or more selected indicia for viewing, the improvement comprising:

first support means supporting said unit for swinging movement about a first axis spaced horizontally from said unit;

second support means supporting said unit for rotation about a second axis; and braking means associated with said second support means for retarding rotation of said unit as it coasts toward a position of rest.

19. In a gambling device according to claim 18, said second support means including a horizontal support arm, said unit journaled on said support arm at one end opposite to said first support means, said braking means including a stationary disk member associated with said support arm and a rotating disk member associated with said unit, said stationary and rotating disk members having magnetic elements in confronting relation to one another whereby upon rotation of said unit and rotating member, said magnetic element on said stationary member is operative to retard rotation of said rotatable disk member and said unit.

20. In a gambling device according to claim 19, said magnetic elements disposed in confronting relation to one another on said stationary disk member and rotatable disk member.

* * * * *